US009556652B2

(12) United States Patent
Lund

(10) Patent No.: US 9,556,652 B2
(45) Date of Patent: Jan. 31, 2017

(54) SLIDING FENESTRATION CONTROL DEVICE

(71) Applicant: Integrity Windows and Doors / Infinity Replacement Windows, Warroad, MN (US)

(72) Inventor: David Lund, Detroit Lakes, MN (US)

(73) Assignee: Integrity Windows and Doors / Infinity Replacement Windows, Warroad, MN (US)

( * ) Notice: Subject to any disclaimer, the term of this patent is extended or adjusted under 35 U.S.C. 154(b) by 0 days.

(21) Appl. No.: 14/565,144

(22) Filed: Dec. 9, 2014

(65) Prior Publication Data

US 2015/0159429 A1 Jun. 11, 2015

Related U.S. Application Data

(60) Provisional application No. 61/914,015, filed on Dec. 10, 2013.

(51) Int. Cl.

| | |
|---|---|
| ***E05C 3/02*** | (2006.01) |
| ***E05B 65/08*** | (2006.01) |
| ***E05C 3/14*** | (2006.01) |
| ***E05C 17/50*** | (2006.01) |
| ***E05B 15/02*** | (2006.01) |
| *E05C 3/00* | (2006.01) |
| *E05C 7/00* | (2006.01) |

(52) U.S. Cl.

CPC ..... *E05B 65/08* (2013.01); *E05B 15/0205* (2013.01); *E05B 65/0841* (2013.01); *E05C 3/14* (2013.01); *E05C 17/50* (2013.01); *E05C 2007/007* (2013.01); *Y10S 292/15* (2013.01); *Y10S 292/46* (2013.01); *Y10T 292/42* (2015.04)

(58) Field of Classification Search

CPC ..... E05C 3/14; E05C 17/50; Y10S 292/46; Y10S 292/15

USPC ..... 292/194, 219, 220, DIG. 20, DIG. 31,292/DIG. 47

See application file for complete search history.

(56) References Cited

U.S. PATENT DOCUMENTS 37,625 A * 2/1863 Hyde ..... E05C 17/50 292/102

198,553 A 12/1877 Von Auer (Continued)

FOREIGN PATENT DOCUMENTS

FR 2572145 A1 4/1986

OTHER PUBLICATIONS

"U.S. Appl. No. 14/669,985, Non Final Office Action mailed Oct. 21, 2015", 18 pgs.

(Continued)

*Primary Examiner* — Carlos Lugo

(74) *Attorney, Agent, or Firm* — Schwegman Lundberg & Woessner, P.A.

(57) ABSTRACT

A window or door limiting device is described having a striker assembly mounted on a window sash or door panel and a corresponding limiting assembly mounted on an adjacent window sash or door panel. The limiting assembly selectively engages the striker assembly with a rotary element to restrict movement of at least one of the first or second window sash or door panel relative to the other of the first or second window sash or door panel. The rotary element is rotatable to selectively engage or disengage the striker assembly to correspondingly restrict movement of one or more of the window sashes or door panels.

41 Claims, 14 Drawing Sheets

(56) References Cited

U.S. PATENT DOCUMENTS

| | | | | | |
|---|---|---|---|---|---|
| 226,033 | A | | 3/1880 | Burns | |
| 278,802 | A | * | 6/1883 | Kubler | E05C 19/06 292/87 |
| 523,736 | A | | 7/1894 | Cazin | |
| 804,994 | A | | 11/1905 | Andrews | |
| 1,016,422 | A | * | 2/1912 | Lauritsen | E05C 17/50 292/121 |
| 1,069,079 | A | * | 7/1913 | Voight | E05F 11/00 292/194 |
| 1,322,677 | A | | 11/1919 | Ditlefsen | |
| 1,350,698 | A | * | 8/1920 | Boedtcher | B66B 13/16 187/331 |
| 1,946,833 | A | | 2/1934 | Brown | |
| 2,158,260 | A | | 5/1939 | Stillman | |
| 3,083,045 | A | * | 3/1963 | Linderoth | E05B 65/0847 292/69 |
| 3,151,901 | A | * | 10/1964 | Aldgren | E05D 13/04 292/124 |
| 3,897,966 | A | | 8/1975 | Draughon | |
| 3,910,614 | A | * | 10/1975 | Coe | E05C 19/02 292/219 |
| 3,912,311 | A | * | 10/1975 | Carvell | E05B 65/0835 292/210 |
| 4,027,907 | A | | 6/1977 | Crepinek | |
| 4,248,461 | A | * | 2/1981 | Stevens | E05B 45/12 292/218 |
| 4,263,747 | A | | 4/1981 | Coltrin et al. | |
| 4,379,576 | A | * | 4/1983 | Blough | E05B 67/383 292/205 |
| 4,383,666 | A | | 5/1983 | Allerding et al. | |
| 4,577,896 | A | | 3/1986 | Crepinsek | |
| 4,580,819 | A | | 4/1986 | Crepinsek | |
| 4,580,820 | A | | 4/1986 | Baber | |
| 4,635,976 | A | * | 1/1987 | Sigler | E05B 65/0847 292/57 |
| 4,639,024 | A | | 1/1987 | Crepinsek | |
| 4,856,229 | A | | 8/1989 | tserng | |
| 4,897,961 | A | | 2/1990 | Shine | |
| 5,452,596 | A | * | 9/1995 | Yamada | E05B 5/003 292/202 |
| 5,457,971 | A | * | 10/1995 | Yamada | E05B 5/003 292/202 |
| 5,647,233 | A | | 7/1997 | Chung | |
| 5,669,256 | A | | 9/1997 | Chung | |
| 6,382,689 | B1 | * | 5/2002 | Brown | E05B 65/0888 292/274 |
| 6,634,681 | B1 | | 10/2003 | Redden | |
| 6,684,454 | B2 | | 2/2004 | Ehrenreich | |
| 7,063,361 | B1 | * | 6/2006 | Lawrence | E05C 3/04 292/241 |
| 7,441,812 | B2 | * | 10/2008 | Welsh | E05B 13/002 292/139 |
| 7,494,164 | B1 | | 2/2009 | Garries et al. | |
| 8,075,038 | B2 | | 12/2011 | Zielinsky | |
| 8,096,593 | B2 | * | 1/2012 | Gibbons | E05B 65/0852 292/262 |
| 8,360,484 | B2 | | 1/2013 | Liang et al. | |
| 8,490,330 | B2 | | 7/2013 | Lund | |
| 8,888,146 | B2 | * | 11/2014 | Taylor | E05C 17/54 292/1 |
| 8,991,228 | B2 | * | 3/2015 | Yang | E05B 65/006 292/336.3 |
| 9,404,288 | B2 | | 8/2016 | Curtis et al. | |
| 2003/0122387 | A1 | * | 7/2003 | Ward | E05B 47/0047 292/341.16 |
| 2007/0182168 | A1 | * | 8/2007 | Allen | E05B 15/024 292/340 |
| 2010/0072763 | A1 | * | 3/2010 | Allen | E05B 15/024 292/340 |
| 2011/0173895 | A1 | | 7/2011 | Lund et al. | |
| 2011/0203184 | A1 | | 8/2011 | Nguyen et al. | |
| 2015/0275556 | A1 | | 10/2015 | Curtis et al. | |

OTHER PUBLICATIONS

"U.S. Appl. No. 13/006,873, Non Final Office Action mailed Nov. 9, 2012", 6 pgs.

"U.S. Appl. No. 13/006,873, Notice of Allowance mailed Apr. 24, 2013", 6 pgs.

"U.S. Appl. No. 13/006,873, Response filed Feb. 8, 2013 to Non Final Office Action mailed Nov. 9, 2012", 11 pgs.

"U.S. Appl. No. 13/006,873, Response filed Oct. 5, 2012 to Restriction Requirement mailed Sep. 20, 2012", 9 pgs.

"U.S. Appl. No. 13/006,873, Restriction Requirement mailed Sep. 20, 2012", 5 pgs.

"Dual Action, Deep Bend", Mighton Products LTD, (Oct. 1, 2010), 1 pg.

"Reverse Retrofit Right Hand", Angel Ventlock™ Products | Reverse Retrofit—Duel Action | Mighton Products, [online]. [retrieved on Sep. 20, 2013]. Retrieved from the Internet: <URL:http://www.angel-ventlock.com/angel-ventlock-products/dual-action/reverse-retrofit>, (2013), 3 pgs.

"U.S. Appl. No. 14/669,985, Notice of Allowance mailed Mar. 28, 2016", 10 pgs.

"U.S. Appl. No. 14/669,985, Response filed Feb. 22, 2016 to Non Final Office Action mailed Oct. 21, 2015", 22 pgs.

"U.S. Appl. No. 14/669,985, Examiner Interview Summary mailed Feb. 22, 2016", 4 pgs.

"Reverse Retrofit Right Hand", Angel Ventlock™ Products | Reverse Retrofit—Duel Action | Mighton Products, [online]. [retrieved on Sep. 20, 2013]. Retrieved from the Internet: <URL: http://www.angel-ventlock.com/angel-ventlock-products/dual-action/reverse-retrofit>, (2013), 3 pgs.

* cited by examiner 82
84
68
80
52
54
78
56
66
74
46
50
70
66
62
64
58
60
40

SLIDING FENESTRATION CONTROL DEVICE

CLAIM OF PRIORITY

This patent application claims the benefit of priority, under 35 U.S.C. Section 119(e), to David Lund, U.S. Patent Application Ser. No. 61/914,015, entitled "SLIDING FENESTRATION CONTROL DEVICE," filed on Dec. 10, 2013, each of which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright MARVIN LUMBER AND CEDAR COMPANY—INTEGRITY WINDOWS AND DOORS. All Rights Reserved.

TECHNICAL FIELD

This document pertains generally, but not by way of limitation, to fenestration systems having sliding window sashes or door panels. More specifically, this document pertains to a control device for limiting the movement of window sashes or door panels sliding within a frame.

BACKGROUND

Vertically and horizontally sliding windows and doors include two or more window sashes or panels that slide within a frame to open or close. The sashes or panels are staggered or positioned to move in parallel travel paths allowing them to move independently of each other. In this arrangement, the sashes or panels can be slid in front and/or behind one another to open the window or door. Conversely, the sashes or panels are arrangeable in one or more of an overlapping edge configuration or an end-to-end configuration to fill the opening of the frame.

Recently, existing and newly manufactured windows have been regulated to require limiting features that limit the extent to which the window is initially opened. The mandated limit, four inches or less, is directed at reducing the likelihood that children will fall through the opening. The limiting features are mandated to automatically engage whenever the window is opened and to require at least two consecutive unlocking actions to discourage children from disengaging the limiting features.

An example of a presently available limiting device includes a pivoting arm inset into the window frame or positioned on a positioning arm or bracket mounted to the window frame. The pivoting arm is initially angled such that the end of the pivoting arm can engage the front edge of the corresponding window sash to arrest the movement of the window sash at a predetermined point, preventing the window from being opened further. The window can be opened further by manually pivoting the pivoting arm until the arm is generally parallel to the edge of the window sash, allowing the window sash to pass the limiting device without engaging the end of the pivoting arm.

The pivoting arm is automatically reengaged by a biasing spring that pivots the pivoting arm into the initial angle once the manual pivoting force is removed. As the pivoting arm is adapted to engage the front edge of the window sash, the biasing spring pushes the pivoting arm against a non-engaging edge of the window sash as the remainder of the window sash is moved past the limiting device. The contact can create friction between the pivoting arm and the sash or cause the pivoting arm to catch on fasteners or other features on the window sash, slowing or restricting further movement of the window sash past the limiting device. In some examples, the problem is made more difficult as the limiting device is partially or entirely covered by the window sash when the pivoting arm is prematurely reengaged. The positioning of the window sash prevents manual pivoting of the pivoting arm to disengage the limiting device. In some cases, in order to free the window sash, the window sash is reversed or the entire window frame disassembled.

As the pivoting arm engages the front edge of the window sash, the proper alignment of the pivoting arm with the front edge increases the likelihood that the pivoting arm will reliably engage the window sash and prevent further movement of the window sash. If the pivoting arm is misaligned with the window sash (e.g. an improperly mounted pivoting arm, an improperly sized pivoting arm for the intended window frame and sash), the pivoting arm may fail to stop the window sash at the proper position or fully disengage from the window sash when manually rotated thereby preventing the window from fully opening. As a result, frame mounted pivoting arm limiting devices are often not cross-compatible with different windows as the spacing between the interior window sash and the window frame or between window sashes can vary preventing accurate alignment of the pivoting arm to reset the device.

Moreover, in other examples, the limiting device often requires a positioning arm or bracket to align the pivoting arm with the front edge of the window sash to engage the window sash and arrest further movement of the window sash. In order to properly align the pivoting arm, the length and angle of the positioning arm are unique to the particular dimensions of the intended window. The unique dimensions of the positioning arm inhibit universal application of the limiting device.

OVERVIEW

The present inventor has recognized, among other things, that the problems to be solved include the difficultly associated with aligning the limiting device with the front edge of the window sash and lack of universal applicability of the presently available limiting devices. Furthermore, the inventor has recognized that these problems can be solved in part by a limiting device having a striker assembly mounted on a first window sash and a corresponding limiting assembly mounted on an adjacent second window sash. The limiting assembly selectively engages the striker assembly to restrict movement of the first window sash relative to the second window sash and vice versa.

In at least one example, the striker assembly includes a striker plate extending from the first window sash toward the second window sash. In another example, the limiting assembly includes a rotary element having an engagement portion. In operation, the rotary element is rotated into an engaged position with the engagement portion aligned with the travel path of the striker plate to prevent further relative movement of the window sashes beyond a predetermined point such as a four inch opening. The rotary element is rotated to a disengaged position with the engagement portion misaligned with the travel path of the striker plate to permit unrestricted movement of the striker plate past the limiting assembly.

In another example, the rotary element has an engagement portion and includes a cutout adjacent the engagement portion. In this configuration, the cutout is aligned with the travel path of the striker plate when the rotary element is rotated to the disengaged position to permit unrestricted movement of the striker plate along the travel path.

By mounting the striker assembly and limiting assembly to their respective window sashes, the mounting and alignment of the components of the limiting device is simplified. As neither component is mounted to the frame, the relative dimensions of the window frame and the window sash do not have to be accounted for in the mounting of the striker assembly and the limiting assembly. Accordingly, the limiting device can be used with a variety of different windows having different window frame and window sash dimensions. In addition, modifications to the window frame such as notches for receiving the limiting assembly or alignment features such as positioning arms or brackets are no longer required. Similarly, the striker assembly is mounted anywhere on the face of the sash and the corresponding assembly is mounted anywhere on the edge of the window sash that aligns with the striker assembly. This arrangement also simplifies the alignment between the striker assembly and the limiting assembly as neither component is mounted to the frame, the alignment of the striker assembly and limiting assembly does not have to account for relative dimensions of the window frame and the window sash. Specifically, the striker and limiting assemblies are installed on adjacent sashes at aligning positions rather than relying on aligning a frame mounted component with a fixed structural feature such as the front edge of the window sash.

In still other examples, spacer plates are coupled between the sash and striker plate to alter the relative extension of the striker plate from the first window sash to account for variations in the distance between the spacing and the first and window sashes. Accordingly, the spacer plates further increase the variety of window systems compatible with the described limiting devices.

This overview is intended to provide an overview of subject matter of the present patent application. It is not intended to provide an exclusive or exhaustive explanation of the subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 4:
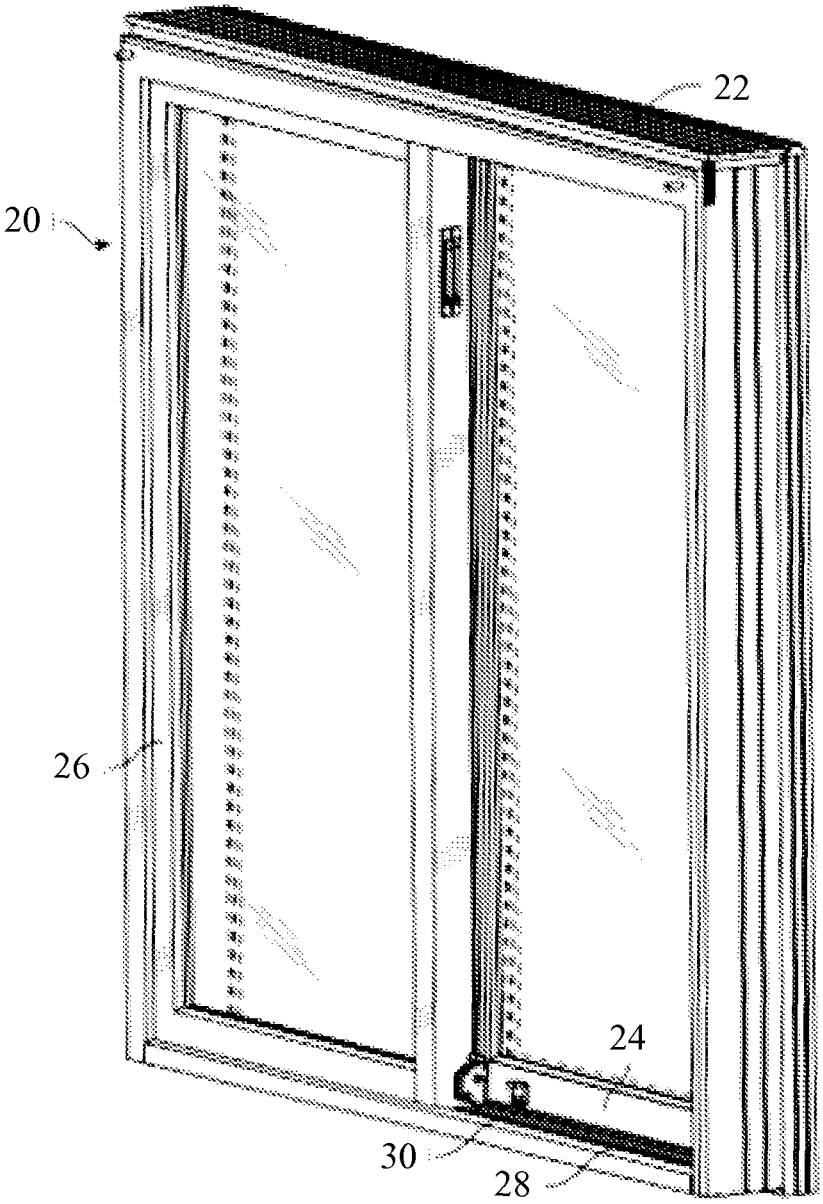
FIG. 4 is a perspective view of a window system having a control device mounted according to an example of the present disclosure.
Figure 5:
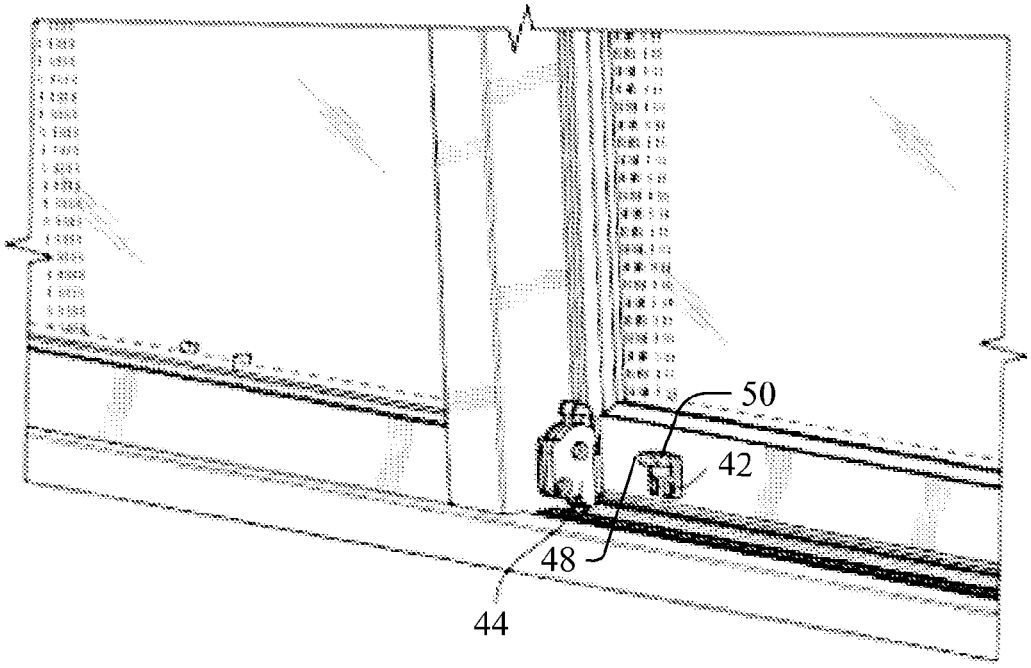
FIG. 5 is a partial perspective view of the window system depicted in FIG. 4.

As depicted in FIGS. 4-5, a window system 20, for use with an example of the present subject matter, generally includes a window frame 22, a first window sash 24 and a second window sash 26. The window frame 22 further includes a first track 28 and a second track 30 oriented parallel to the first track 28. Each window sash 24, 26 comprises a rectangular shape having horizontal and vertical edges. The first window sash 24 is slidably received within the first track 28. Similarly, the second window sash 26 is slidably received within the second track 30 such that the first window sash 24 and the second window sash 26 are slidable within their respective tracks 28, 30 along parallel linear paths. Typically, the tracks 28, 30 are oriented in either vertical or horizontal orientations. The window system 20 is opened by sliding at least one of the first window sash 24 or the second window sash 26 such that at least a portion of the window sash 24, 26 is overlapped with the other window sash 24, 26, such that the total surface area of the window sashes 24, 26 is less than the opening defined by the window frame 22. As depicted, the window system 20 comprises a pair of window sashes 24, 26. It is contemplated, that the window system 20 can comprise more than two window sashes 24, 26.

Although depicted as for use with a window system, examples of the present subject matter are operable with other fenestration systems including, but not limited to, multi-panel windows, multi-panel doors and other fenestration systems. Accordingly, for the purposes of this disclosure, it is contemplated that a window sash includes, but is not limited to, a window sash, door panel or other equivalent fenestration structure. Similarly, it is contemplated that a window frame corresponds to a door frame or other equivalent fenestration structure.

Figure 1:
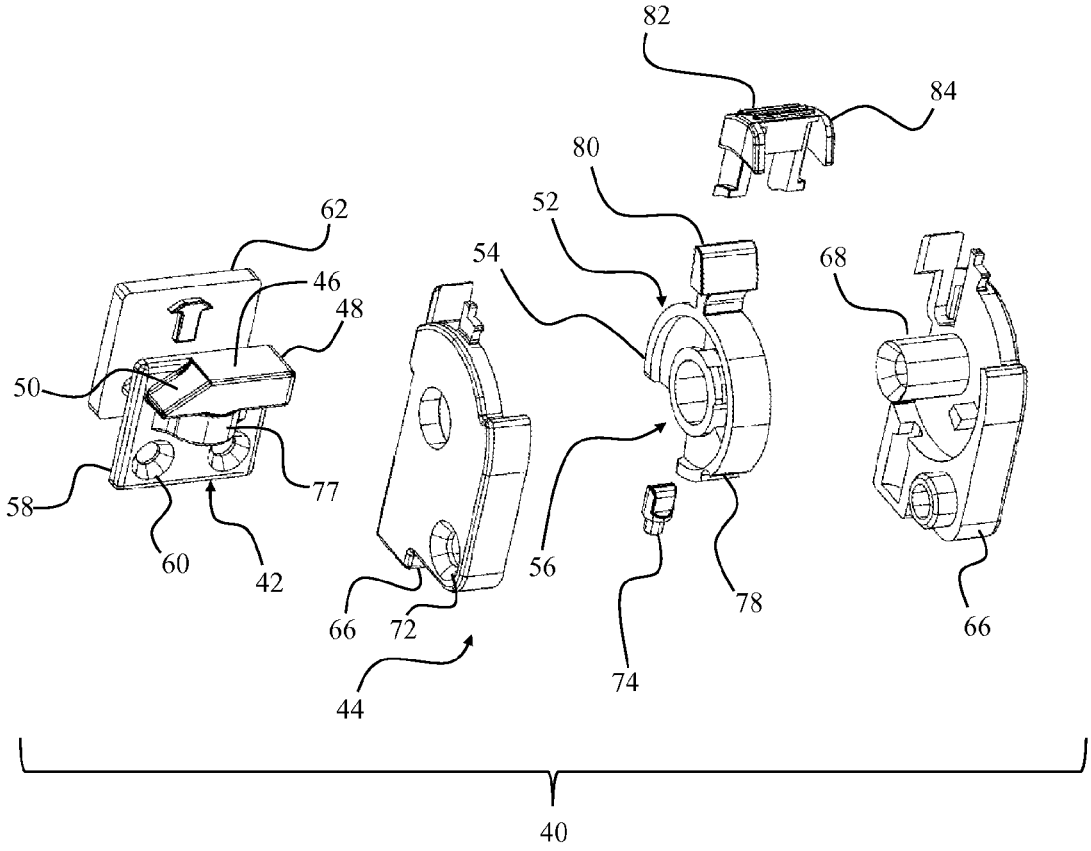
FIG. 1 is a front perspective exploded view of a control device according to an example of the present disclosure.
Figure 2:
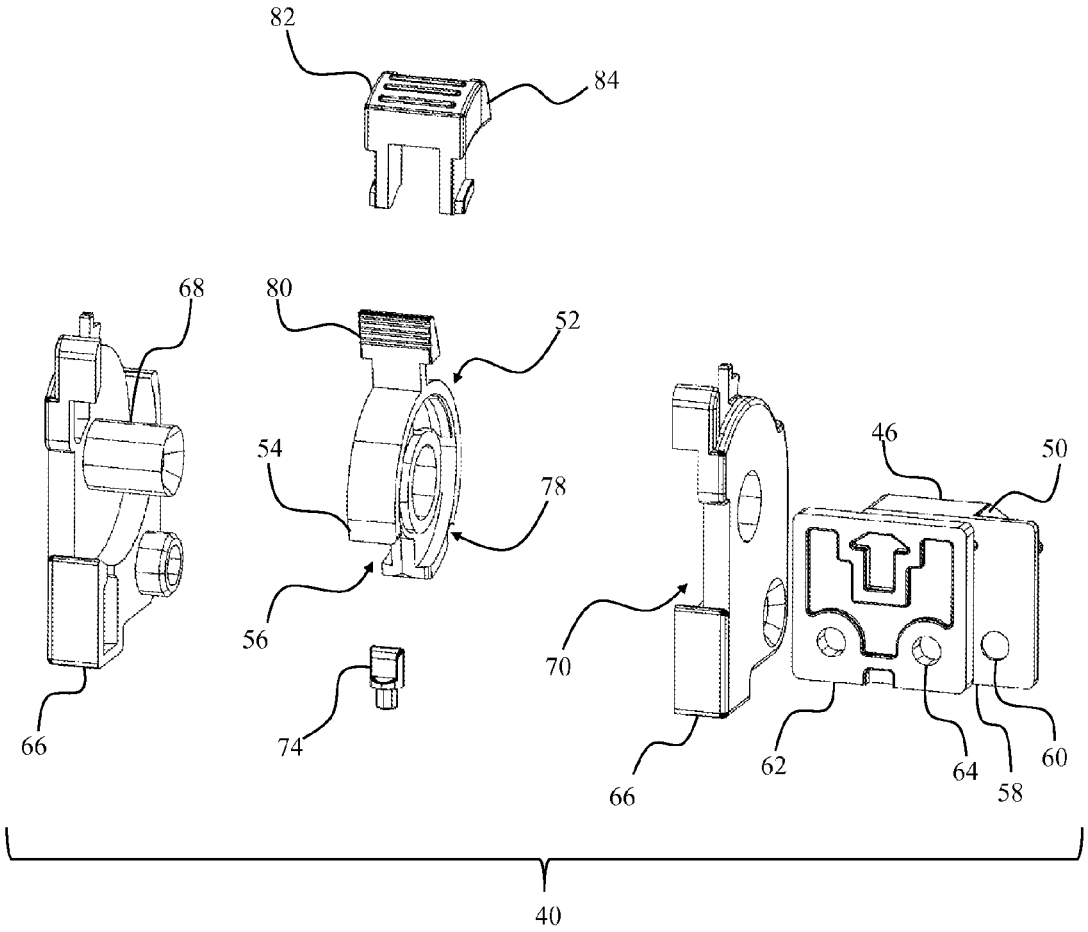
FIG. 2 is a rear perspective exploded view of a control device according to an example of the present disclosure.
Figure 3:
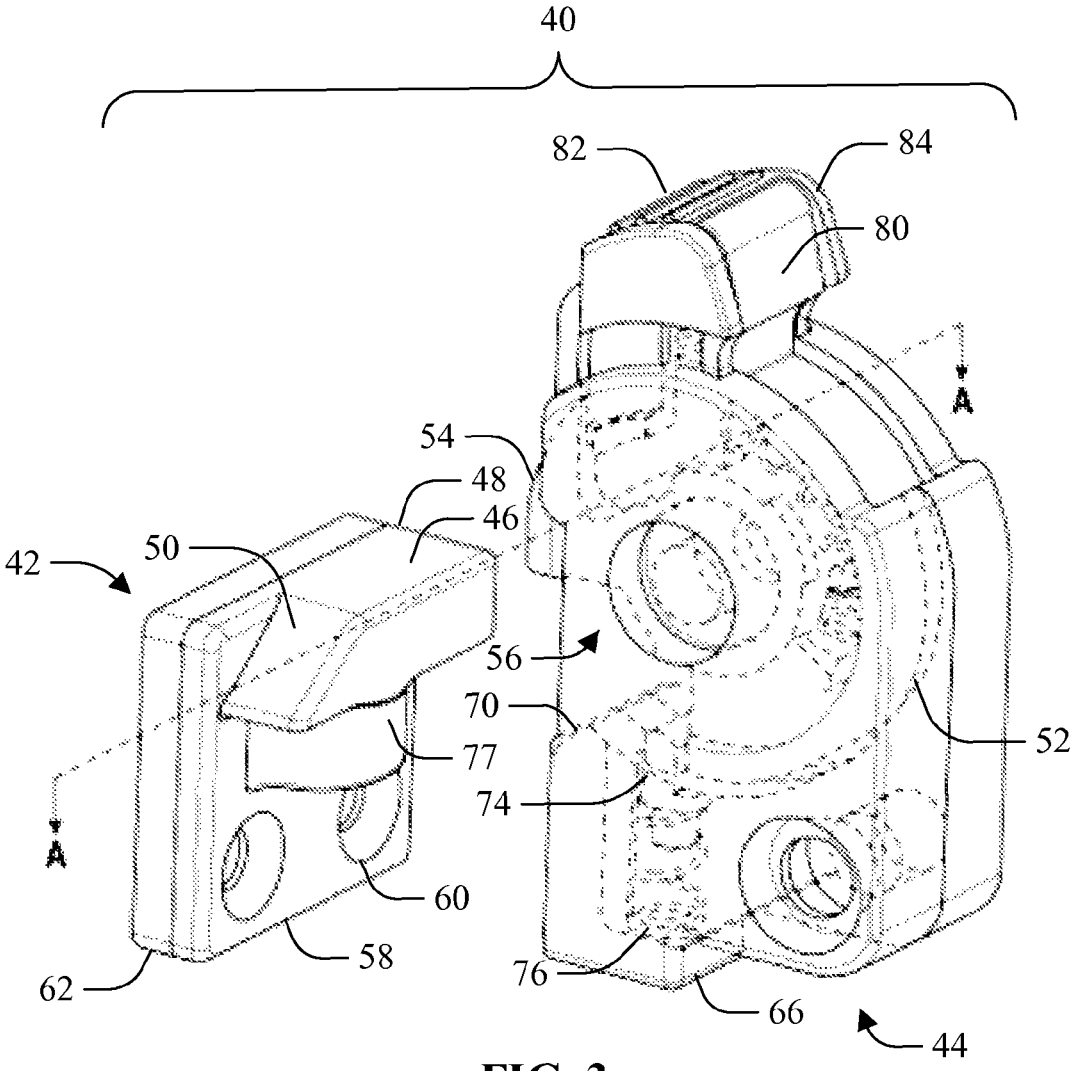
FIG. 3 is a perspective view of a control device having a housing ghosted to illustrate the operation of the control device.

As depicted in FIGS. 1-3, a control device 40, according to an example of the present subject matter, includes a striker assembly 42 and a limiter assembly 44. In an example, the striker assembly 42 is positioned on a face of the frame of the first window sash 24 and the limiter assembly 44 is positioned on a vertical edge of the second window sash 26. Alternatively, the striker assembly 42 and the limiter assembly 44 are reversed with the striker assembly 42 on the second window sash 26 and the limiter assembly 44 on the first window sash 24. It is understood from this disclosure that the reference to the first window sash 24 and the second window sash 26 are for organizational purposes and the control device 40 and the striker assembly 42 can be interchangeably mounted on either the first window sash 24 and the second window sash 26 in varying examples of the present disclosure.

The striker assembly 42 includes a striker plate 46 extending from the face of the first window sash 24, such that a portion of the striker plate 46 is positioned to move along a linear path A-A (shown in FIG. 3), for instance as the first window sash 24 slides within the first track 28. In at least one example, the striker plate 46 extends transversely from the face of the first window sash 24. In another example, the striker plate is positionable to extend at a plurality of different extension angles (e.g., not just transversely). In at least one example, the striker plate 46 includes a stop face 48 and an angled face 50 positioned opposite the stop face 48. As shown in FIG. 3, the stop face 48 and the angled face 50 are positioned on the striker plate 46 such that the stop face 48 and the angled face 50 are aligned with the linear path A-A.

As depicted in FIGS. 1 and 2, the limiter assembly 44 includes a rotary element 52 having an engagement portion 54 and a cutout 56. The rotary element 52 is operably engaged to a vertical edge of the second window sash 26. As shown in FIG. 3, the rotary element 52 is rotatable between an engaged position in which the engagement portion 54 is aligned with the linear path A-A (specifically shown in FIG. 3) and a disengaged position in which the cutout 56 is aligned within the linear path A-A (with rotation of the rotary element 52 from the orientation shown in FIG. 3).

Figure 7:
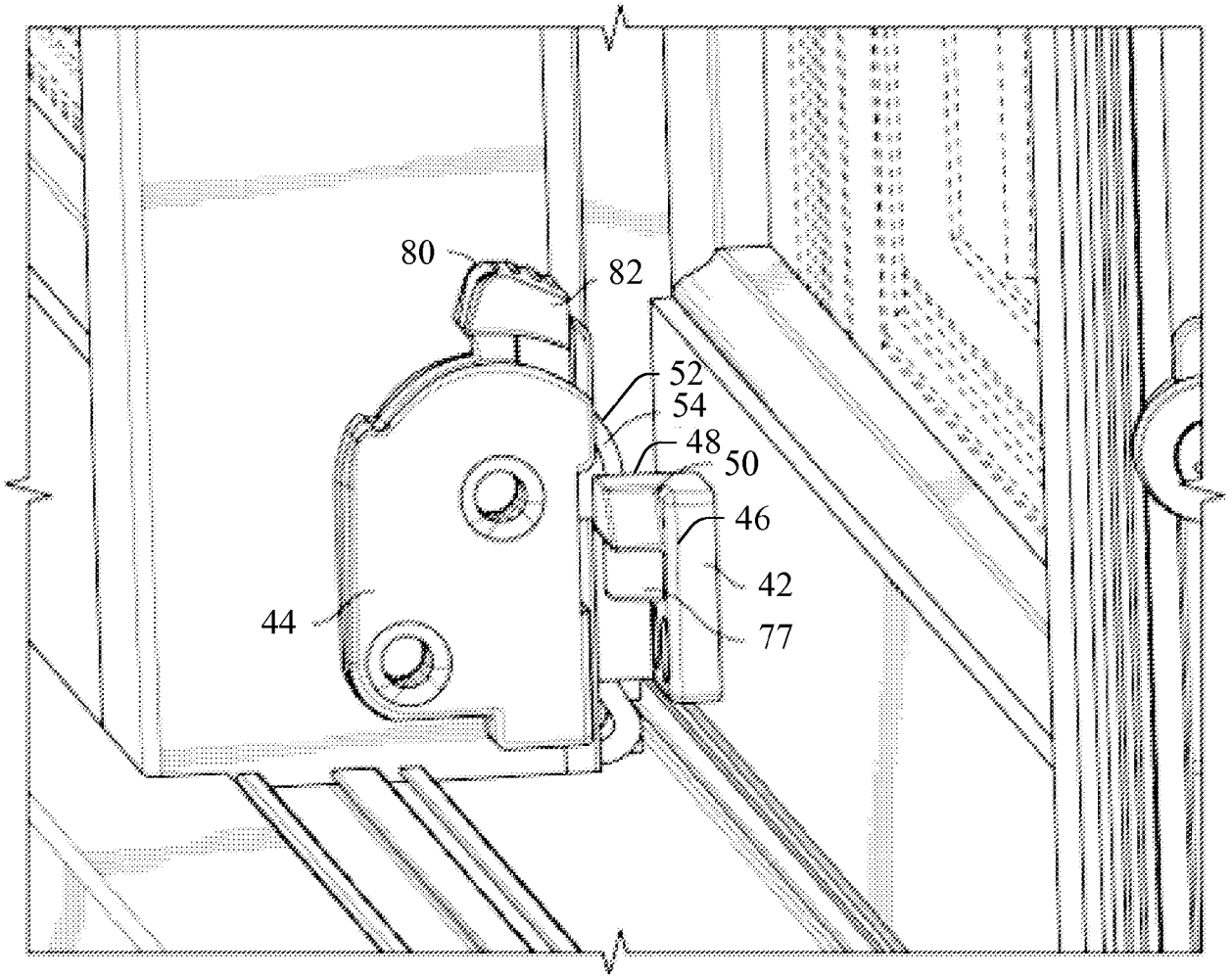
FIG. 7 is a partial perspective view of a control device mounted to a window system, wherein a rotary element of the control device is rotated to engage a strike plate.

Referring now to FIG. 7, in operation, the rotary element 52 is positioned in the engaged position such that sliding of either window sash 24, 26 within their respective tracks 28, 30 to open the window system 20 engages the stop face 48 to the engagement portion 54 preventing the further movement of the window sash 24, 26. The striker plate 46 is positioned on the first window sash 24 to limit the distances one or more of the window sashes 24, 26 can be moved before the striker plate 46 engages the rotary element 52, which limits further opening of the window system 20. In at least one example, the striker plate 46 is positioned to limit the relative movement of the window sashes 24, 26 such that the window system 20 is only opened about four (4) inches before the striker plate 46 engages the rotary element 52. The engagement of the stop face 48 of the striker plate 46 with the engagement portion 54 of the rotary element 52 ensures the window system 20 is only opened a specified amount, in this example approximately four (4) inches in compliance with window opening control regulations. In other examples, the limiter assembly 44 and the striker assembly 42 are installed to facilitate the opening of the window system 20 to varying specified amounts according to the location of the assemblies 44, 42 on the sashes 24, 26. Conversely, rotating the rotary element 52 to align the cutout 56 with the linear path A-A (see FIG. 3) allows the striker plate 46 to pass the rotary element 52. The sashes 24, 26 are thereafter movable into fully open positions as is normally allowed by the window frame 22 of the window system 20.

As discussed herein, and shown in FIG. 7, the stop face 48 of the striker plate 46 is positioned to engage the engagement portion 54 to prevent further movement of the window sashes 24, 26. In this configuration, the striker plate 46 is positioned such that the stop face 48 engages the engagement portion 54 when the window sashes 24, 26 are moved to open the window system 20 beyond the movement allowed according to the installation of the limiter assembly 44 and the striker assembly 42.

Figure 8:
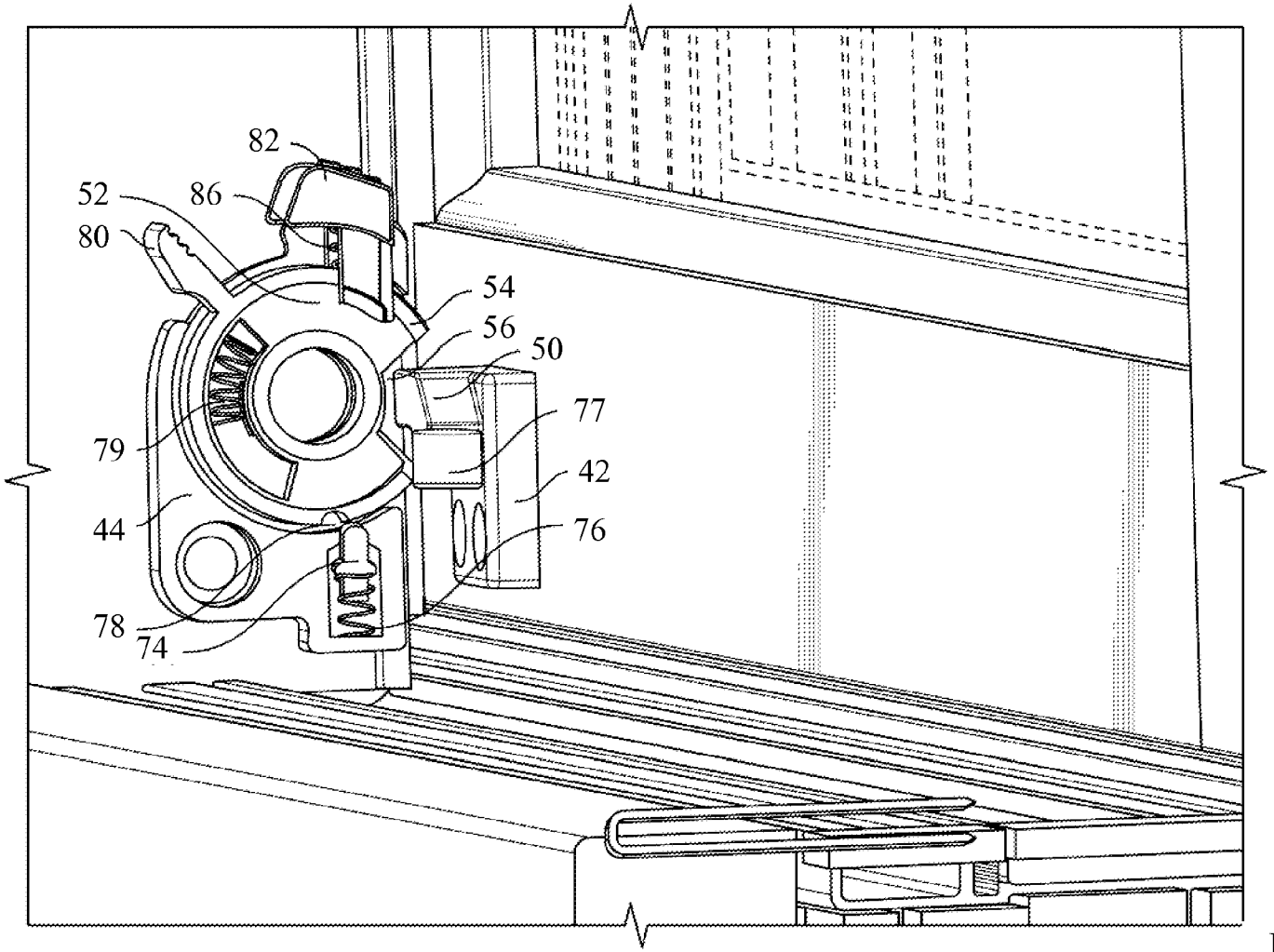
FIG. 8 is a partial cross-sectional perspective view of a control device mounted to a window system, wherein a rotary element of the control device is rotated to misalign with a strike plate.
Figure 9:
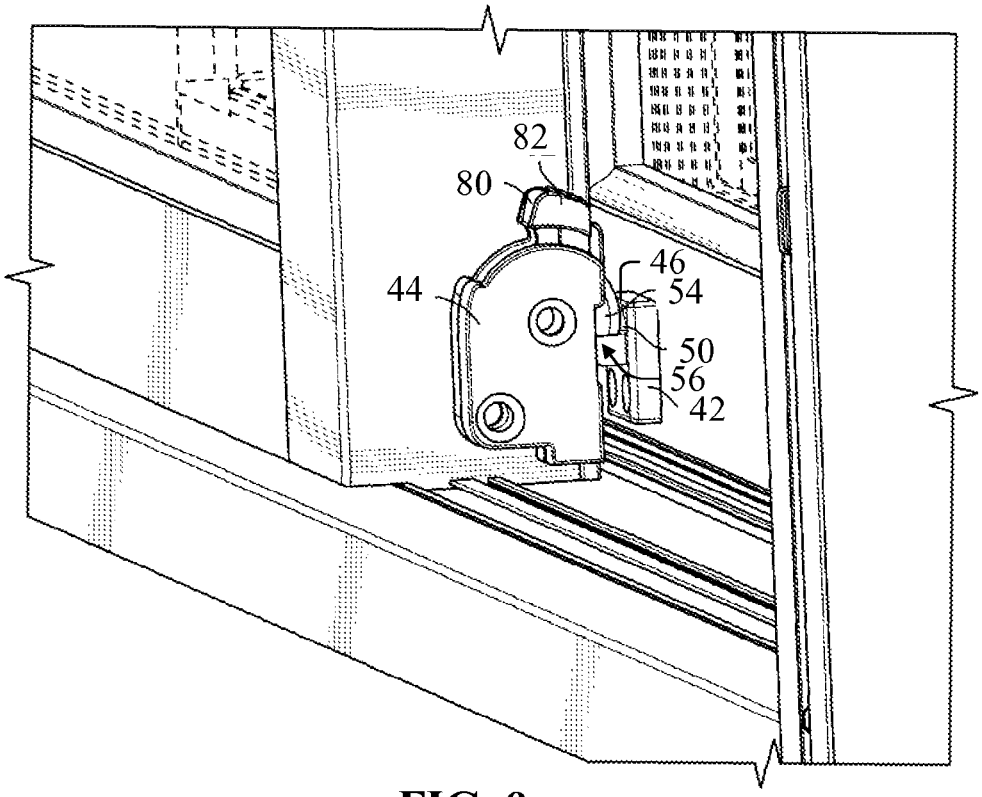
FIG. 9 is a partial perspective view of a control device mounted to a window system, wherein a rotary element of the control device is engaged by an angled face of a strike plate.
Figure 10:
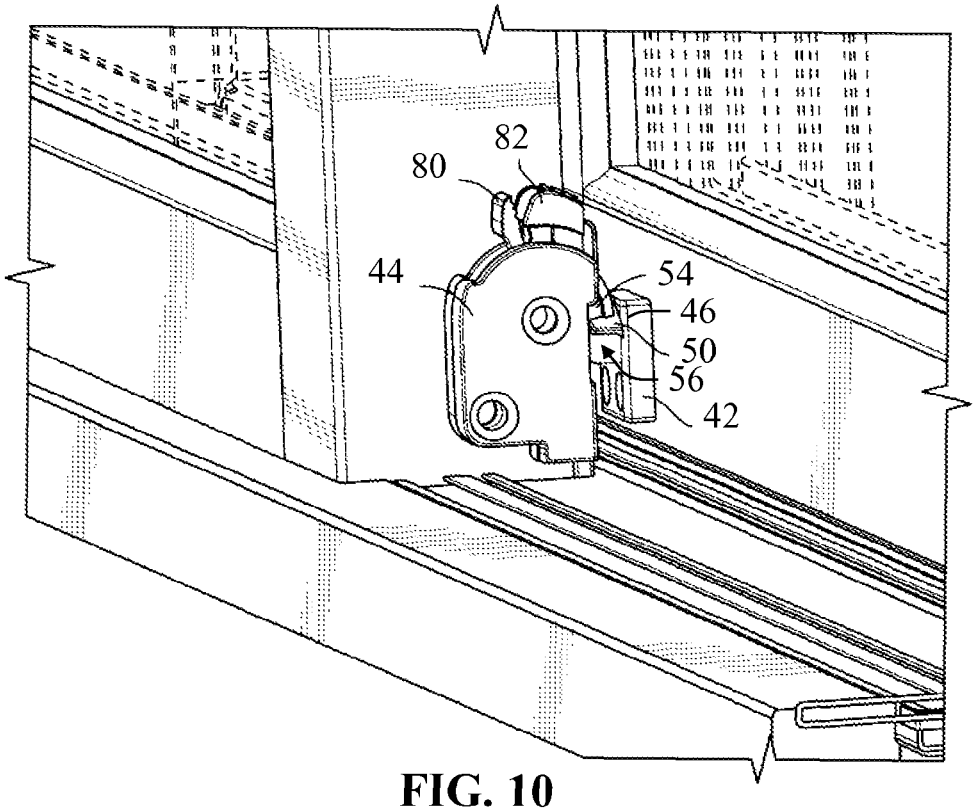
FIG. 10 is a partial perspective view of the control device mounted to a window system, wherein the angled face is rotating the rotary element out of alignment with the strike plate.
Figure 11:
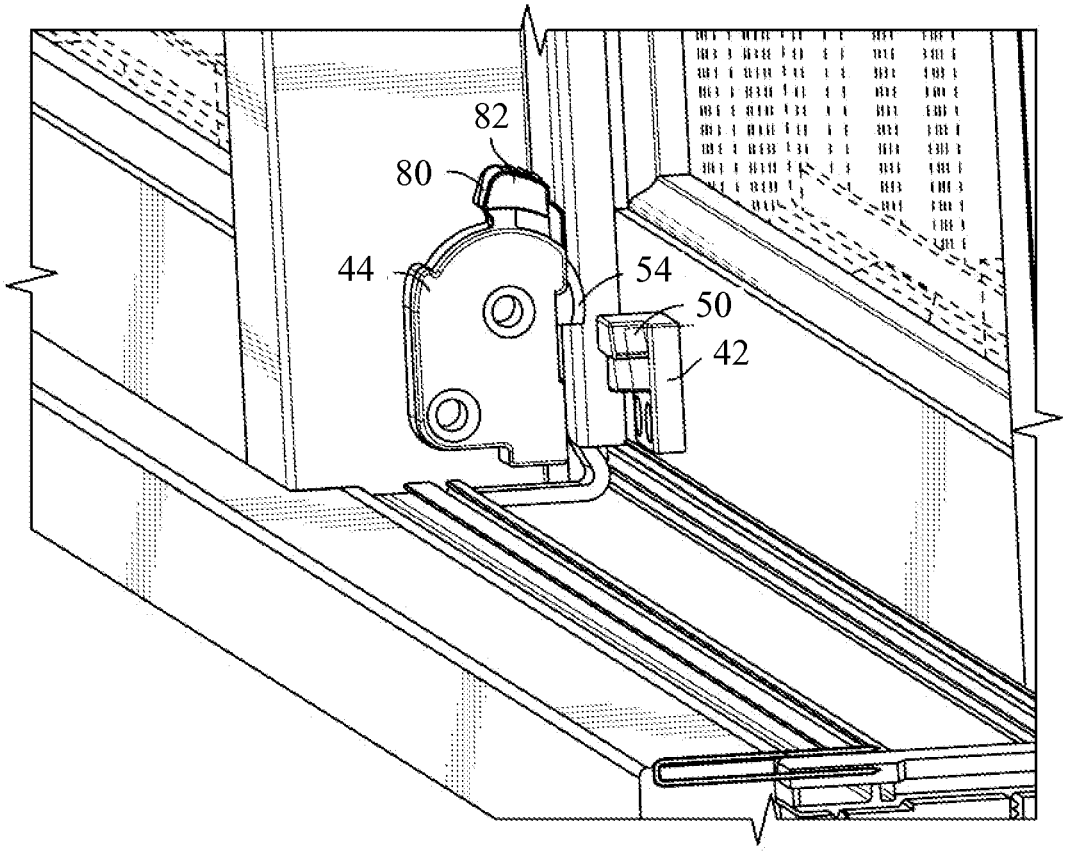
FIG. 11 is a partial perspective view of the control device mounted to a window system, wherein the angled face has rotated the rotary element out of alignment with the strike plate, allowing the strike plate to pass the rotary element.

In contrast, the angled face 50 (FIGS. 7 and 8) is ramped relative to the engagement portion 54 (and the linear path A-A shown in FIG. 3). FIGS. 9 and 10 show the window system 20 with at least one of the sashes 24, 26 in an open configuration past the engagement of the stop face 48 of the striker plate 46 and the engagement portion 54 (e.g., an opening greater than four (4) inches). FIGS. 9 and 10 are staged views of the engagement of the angled face 50 with the engagement portion 54. As the angled face 50 is engaged with the engagement portion 54 the angled face 50 biases the rotary element 52 and rotates the element to the disengaged position to permit the striker plate 46 to pass the limiter assembly 44 (as shown in FIGS. 9 and 10). As depicted in FIGS. 9-11, the angled face 50 is opposite the stop face 48 (see e.g. FIGS. 1 and 3) such that the angled face 50 engages the engagement portion 54 when the window sashes 24, 26 are moved to close the window system 20. Accordingly, the control device 40 (including limiter assembly 44 and the striker assembly 42), limits the movement of the window sashes 24, 26 when the window sashes 24, 26 are moved to open the window system 20 (e.g., with the stop face 48) and otherwise allows for the closing of the window system 20 (e.g., with the angled face 50) without interruption by the control device 40. Further, the control device 40 automatically resets itself with closing of the window system 20 through the sliding and biasing engagement of the angled face 50 to the engagement portion 54. As further described herein, the rotary element 52 with the engagement portion 54 is biased with a biasing element, such as a spring, toward the engaging position along line A-A (shown in FIG. 3). Accordingly, as the window system 20 is closed and the angled face 50 biases the engagement portion 54 (see FIGS. 9 and 10), the biased rotary element 52 will automatically reset the engagement portion 54 to the orientation shown in FIGS. 3 and 7.

Figure 13:
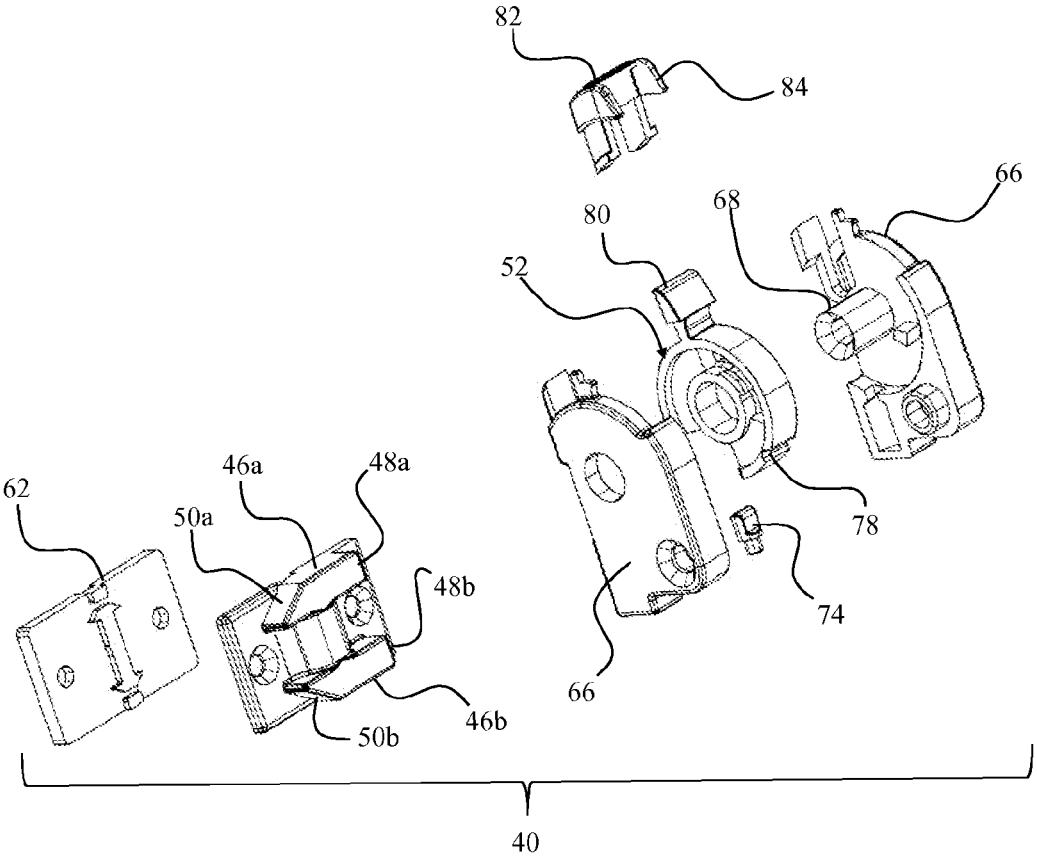
FIG. 13 is a front perspective exploded view of a control device according to an example of the present disclosure.

In at least one example, the control device 40 is provided as a kit with at least two striker plates similar to the striker plate 46 shown herein. The positions of the stop face 48 and the angled face 50 are reversed for each of the striker plates included in a kit such that a first striker plate **46*a* is provided in a right handed configuration and a second striker plate 46*b* is provided in a left handed configuration as shown in FIG. 13. One example of a left-handed striker plate (e.g., prevents movement of the window sash 26 in a right direction) is shown in FIG. 5, and shown in additional detail in FIGS. 6-11. A right-handed striker plate is shown in FIG. 3 and accordingly includes the stop face 48 and the angled face 50 in reversed positions relative to FIG. 4. In this configuration, one of the striker plates 46 is selected and mounted according to the direction in which the window system 20** is to be opened.

As depicted in FIGS. 1-2, in at least one example, the striker assembly 42 further includes a base plate 58 from which the striker plate 46 extends (e.g. transversely), the base plate 58 having at least one opening 60 for receiving a fastener to secure the striker plate 46 to the frame of the first window sash 24. In at least one example, the striker assembly 42 includes at least one spacer plate 62 having at least one opening 64 (shown in FIG. 2) corresponding to the opening 60 of the base plate 58. Each spacer plate 62 adjusts the relative position of the striker plate 46 to account for variations in the spacing between the first and second window sashes 24, 26 and to position the stop face 48 and the angled face 50 of the striker assembly 42 within the linear path A-A (shown in FIG. 3). In certain examples, the striker assembly 42 includes a plurality of spacer plates 62 of uniform or non-uniform thicknesses in the manner of the kit discussed herein to facilitate installation with a variety of fenestration systems.

Figure 12:
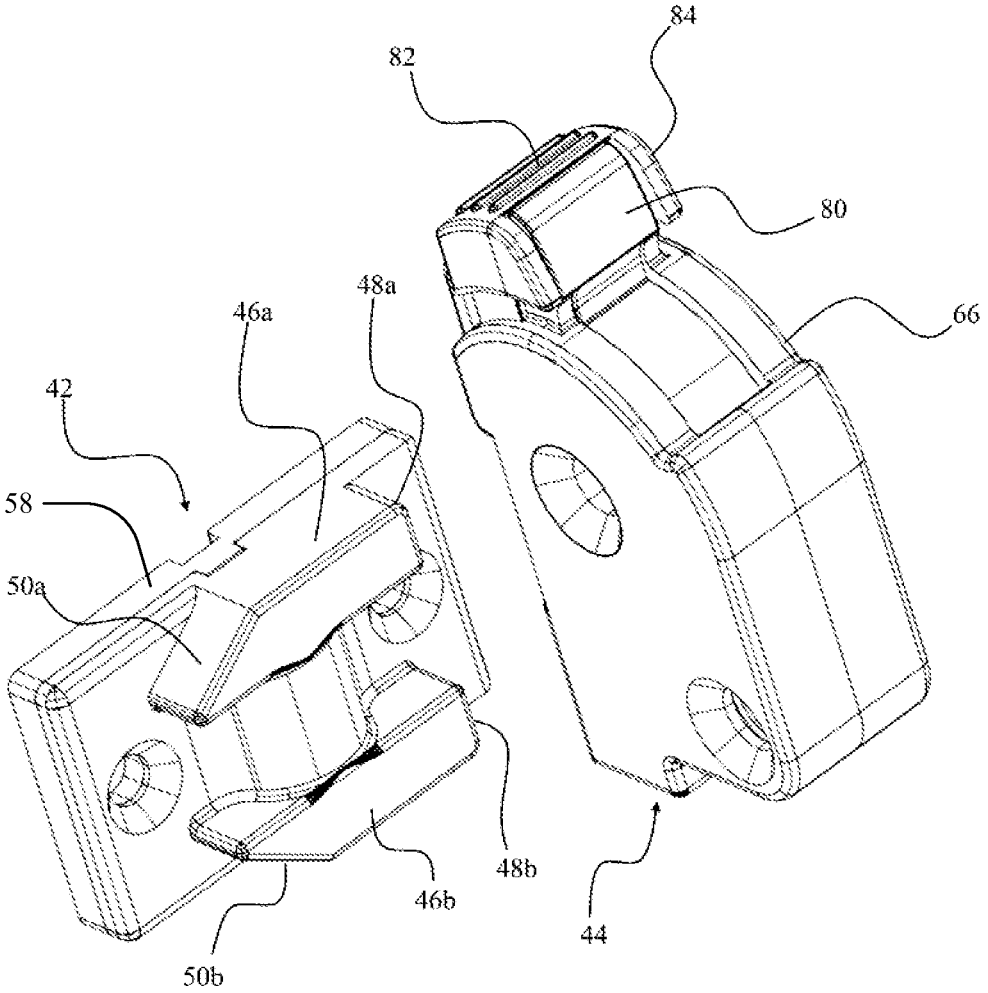
FIG. 12 is a front perspective view of a control device according to an example of the present disclosure.

As depicted in FIGS. 12-13, in at least one example, the striker assembly 42 comprises at least two striker plates 46*a*, 46*b* extending from the base plate 58, wherein the stop face 48*a*, 48*b* and the angled face 50*a*, 50*b* of the striker plates 46*a*, 46*b* are arranged in the same orientation. In this configuration, the base plate 58 operates ambidextrously such that the base plate 58 is rotatable on the face of the first window sash 24 to position one of the striker plates 46*a* in alignment with the linear path A-A (shown in FIG. 3). The base plate 58 can be further rotated to position the other striker plate 46*b* into alignment with the linear path A-A, which effectively reverses the orientation of the stop face 48*b* and the angled face 50*b*. Accordingly, the desired striker plate 46*a*, 46*b* is selected and mounted according to the direction the window system 20 is opened.

Figure 14:
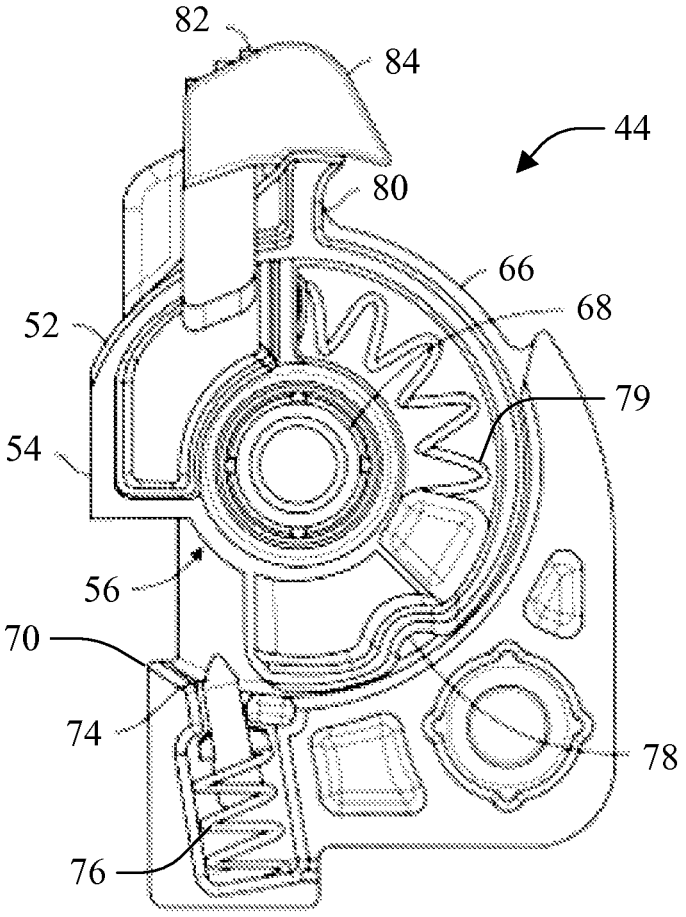
FIG. 14 is partial cross-sectional side view of a limiter assembly according to an example of the present disclosure.

Referring again to FIG. 3 and to FIG. 14, in at least one example, the limiter assembly 44 includes a housing 66 defining an inner space for receiving the rotary element 52 and having a pin 68 (as shown in FIGS. 1 and 2) insertable through the rotary element 52 to facilitate rotation of the rotary element 52 relative to the housing 66. The housing 66 comprises a striker plate opening 70 positioned proximate the linear path A-A (shown in FIG. 3). The engagement portion 54 of the rotary element 52 is positioned by the housing 66 when installed to protrude from the striker plate opening 70 while in the engaged position. Similarly, rotating the rotary element 52 into the disengaged position aligns the cutout 56 with the striker plate opening 70 to permit the striker plate 46 to pass through the cutout 56 and the striker plate opening 70 (e.g., to allow full opening of the window system 20). As depicted in FIG. 3, in this configuration, the striker plate opening 70 comprises a U-shape, V-shape or other equivalent shape permitting the striker plate 46 to pass through the striker plate opening 70 from either direction along the linear path A-A.

As shown in FIG. 1, in at least one example, the housing 66 includes at least one opening 72 extending through the housing 66. Each opening 72 is adapted to receive a fastener to affix the housing 66 and correspondingly the rotary element 52 to one of the window sashes 24, 26. The fastener can be reversed and inserted through the opening 72 in the opposite direction to secure the housing 66 to the opposing vertical edge of the second window sash 26. This configuration permits the housing 66 to be selectively positioned on one of window sashes 24, 26 (as shown in FIG. 4) depending on the installation constraints (e.g. obstructions around the window system 20) or the desired sliding direction of the window sashes 24, 26.

As depicted in FIGS. 3 and 14, in at least one example, the housing 66 also includes a detent 74 and a biasing spring 76. The biasing spring 76 biases the detent 74 against the rotary element 52. When the rotary element 52 is positioned in the engaged position, the detent 74 is extended by the biasing spring 76 into the cutout 56 to maintain the rotary element 52 in the engaged position. Stated another way, the biased detent 74 locks the rotary element 52 in the engagement position and ensures the window system 20 is not unintentionally opened beyond the amount specified by the control device 40. In certain examples, the rotary element 52 includes a retention notch 78 (as shown in FIG. 14) positioned to receive the detent 74 when the rotary element 52 is rotated into the disengaged position to maintain the rotary element 52 in the disengaged position.

As depicted in FIGS. 1-3 and 14, in at least one example, the rotary element 52 includes a lever 80 extending from the housing 66. The lever 80 can be manually actuated to rotate the rotary element 52 between the engaged and disengaged positions. In certain examples, the housing 66 includes a button 82 having at least one wing 84, wherein the button 82 and wing 84 cover a portion of the lever 80. The button 82 can be depressed to expose the lever 80 and to permit rotation of the lever 80. The housing 66 also includes a button spring for biasing the button 82 to the original position after the button 82 is released. In an example, the button spring is positioned within the housing 66 beneath the button 82 such that when the button 82 is depressed, the button spring is compressed. Upon releasing the button 82, the button spring 86 (as shown in FIG. 8) extends biasing the button 82 to the original position. In an example, the rotary element 52 includes an angled portion on the lever 80 engagable to the button 82 as the rotary element 52 rotates into the engaged position. The angled portion engages the button 82 to move the button to the original position 82. In certain examples, the button 82 can includes a corresponding angled surface engagable by the angled portion to facilitate movement of the button 82 to the original position.

Figure 6:
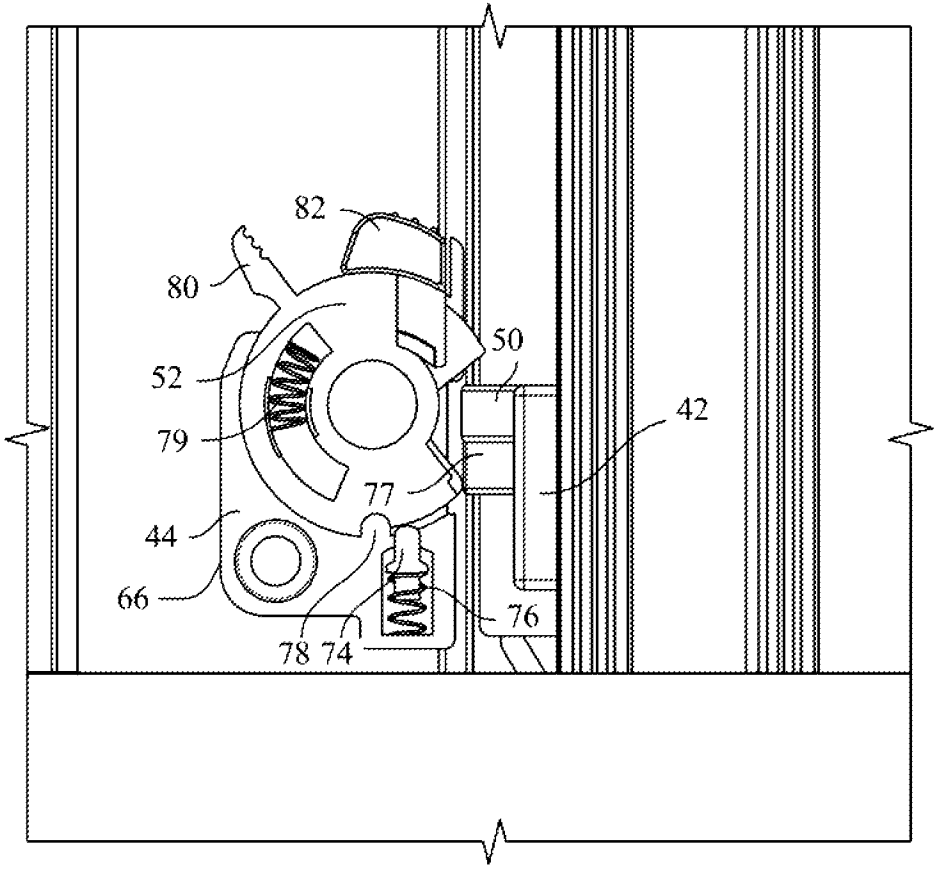
FIG. 6 is a partial cross-sectional side view of a control device mounted to a window system according to an example of the present disclosure.

As depicted in FIGS. 1, 3 and 7-8, in at least one example, the striker plate 46 includes a release portion 77. As shown in FIG. 1, in one example the release portion 77 includes a rounded shape. The release portion engages with the engagement portion 54 in the disengaged position (held with the detent 74 and the retention notch 78) as the striker plate 46 passes through the cutout 56. As shown in FIG. 6, the release portion 77 rotates the rotary element 52 and disengages the detent 74 from the retention notch 78. That is to say, the release portion 77 provides a gradual incline (ramp) that rotates the rotary element 52 to depress the detent 74 into the housing 66 and out of the notch 78. In the example shown in FIG. 6, the release portion 77 includes inclines on both faces (opening and closing directions) and thereby releases the rotary element 52 with both closing and opening movements of one or more of the sashes 24, 26.

As shown in FIGS. 6 and 14, the housing 66 includes a biasing element, such as a spring 79. The spring 79 biases the rotary element 52 toward the engaged position. Accordingly, as the release portion 77 rotates the rotary element 52 and disengages the detent 74 the spring 79 biases the rotary element 52 back toward the engaged position (see FIG. 7 showing the engaged position). The release portion 77 thereby automatically resets the control device 40 to bias the engagement portion 54 toward the engaged position (e.g., after previous retention by the detent 74). The angled face 50 thereafter allows the striker assembly 42 to slide through the reset control device 40 including the rotary element 52. Stated another way, the release portion 77 cooperates with the angled face 50 of the striker plate 46 to reset the rotary element 52 and allow for passage of the striker plate 46 through the limiter assembly 44 during closing of the window system 20. The window system 20 can be opened past the limited distance when the rotary element 52 is rotated into the disengaged position. The angled face 50 of the striker plate 46 engages the release portion 77 to bias the rotary element 52 and return the rotary element 52 to the engaged position (e.g., with the spring 79) thereby automatically relocking the rotary element 52 when the window system 20 is closed.

As depicted in FIGS. 6-11, during assembly, the striker assembly 42 is positioned on a face of the first window sash 24 by inserting a fastener through openings 60 of the base plate 58 and into the first window sash 24. As needed, at least one spacer plate 62 (as depicted in FIGS. 1-3) is positioned between the base plate 58 and the first window sash 24 to extend the base plate 58 outward from the first window sash 24 to align the striker plate 46 including the stop face 48 and the angled face 50 of the striker plate 46 with the linear axis A-A.

As is also depicted in FIGS. 6-11, the limiter assembly 44 is affixed to a vertical edge of the second window sash 26 by inserting a fastener through the opening 72 in the housing 66 into the second window sash 26. The limiter assembly 44 is positioned on the vertical edge of the second window sash 26 such that the protruding portion of the engagement portion 54 is aligned with the linear axis A-A when the rotary element 52 is rotated into the engaged position.

Figure 15:
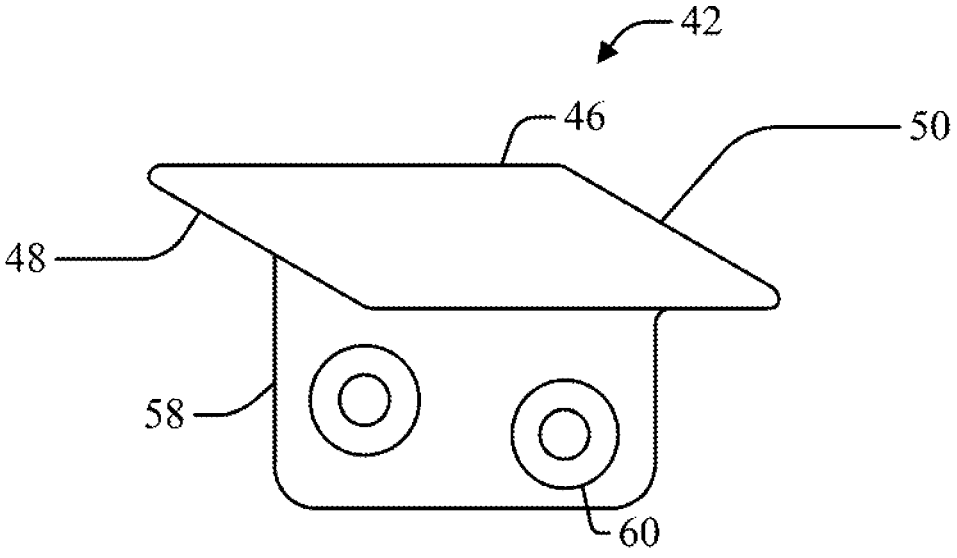
FIG. 15 is a side view of a striker assembly according to an example of the present disclosure.

As illustrated in FIG. 14, the rotary element 52 is rotated into the engaged position by the biasing spring 79 such that the engagement portion 54 protrudes through the striker plate opening 70. In operation, moving one or more of the first or second window sashes 24, 26 to open the window system 20 engages the engagement portion 54 with the striker plate 46 as shown in FIG. 7. The striker plate 46 is oriented such that moving either the first or second window sash 24, 26 engages the stop face 48 to the rotary element 52 without rotating the rotary element 52, thereby arresting further movement of the first or second window sash 24, 26 and preventing further opening of the window system 20. As depicted in FIG. 15, in at least one example, the stop face 48 can also be angled such that an edge of the stop face 48 engages the rotary element 52 to prevent movement of the striker assembly 42 past the limiter assembly 44. The orientation of the angle of the stop face 48 prevents the biasing of the rotary element 52 as otherwise described herein. However, the angled stop face 48 and opposed angled face 50 are usable in right and left hand installations.

As previously described, in at least one example, the button 82 is provided with the limiter assembly 44 and is depressed to expose the lever 80. As depicted in FIG. 8, after depression of the button 82 the lever 80, is actuated to rotate the rotary element 52 and overcome the force of the spring 76 positioning the detent 74 in the cutout 56 (and the spring 79). The rotary element 52 is rotated into the disengaged position, aligning the cutout 56 with the linear path A-A (see FIG. 3). The biasing spring 76 inserts the detent 74 into the retention notch 78 to maintain the rotary element 52 in the disengaged position. The first or second window sash 24, 26 is moved past the striker plate 46 through the cutout 56 and past the limiter assembly 44 to allow full opening of the window system 20. As the striker plate 46 passes through the cutout 56, the release portion 77 engages the misaligned (rotated) engagement portion 54 to rotate the rotary element 52. Rotation of the rotary element 52 according to the bias provided by the release portion 77 disengages the detent 74 from the retention notch 78 allowing the spring 79 to rotate the rotary element 52 back to the engaged position.

In one example, an angled portion of the stop face 48 engages a portion of the rotary element 52 adjacent the cutout 56 to rotate the rotary element 52 disengaging the detent 74 from the retention notch 78 allowing the biasing spring 79 to rotate the rotary element 52 back to the engaged position. As depicted in FIG. 15, in an example, the stop face 48 can be angled such that the stop face 48 is generally parallel to the angled face 50 to facilitate engagement of the stop face 48 with a portion of the rotary element 52 adjacent the cutout 56. In at least one example, the stop face 48 can be angled along a plane transverse to the angle of the angled face 50. In this configuration, the angled portion of the stop face 48 operates in the same manner as the release portion 77 to disengage detent 74 and permit the rotary element 52 to rotate into the engaged position. The angle of the stop face 48 causes the rotary element 52 to rotate such that the detent 74 is engaged by the portions of the rotary element 52 adjacent the retention notch 78. The adjacent portions press the detent 74 downward to compress the spring 79 until the retention notch 78 is out of alignment with the detent 74.

The angled face 50 of the striker plate 46 is opposite the stop face 48 such that moving the first and second window sashes 24, 26 toward the closed position engages the engagement portion 54 to the angled face 50 as illustrated in FIG. 9. The angled face 50 rotates the rotary element 52 towards the disengaged position (as shown in FIG. 10) to permit the striker plate 46 to pass through the cutout 56, thereby permitting the first or second window sashes 24, 26 to be moved to closed the windows unrestricted (as shown in FIG. 11). The spring 79 then automatically biases the rotary element 52 and the engagement portion 54 toward the engagement position after the striker plate 46 passes.

VARIOUS NOTES & EXAMPLES

Each of these non-limiting examples can stand on its own, or can be combined in any permutation or combination with any one or more of the other examples.

Example 1 can include subject matter such as a window system, comprising a window frame; a first window sash slidably received within the window frame; a striker assembly including a striker plate extending transversely from the first window sash; a second window sash slidably received within the window frame; and a limiter assembly coupled to the second window sash, the limiter assembly including a rotary element comprising an engagement portion. The rotary element is rotatable to an engaged position where the engagement portion is positioned to engage the striker plate when at least one of the window sashes is slid within the window frame to prevent further movement of the sliding window sash. The rotary element is rotatable to a disengaged position in which the engagement portion is misaligned with the striker plate allowing the striker plate to pass the engagement portion when at least one of the window sashes is slid within the window frame.

Example 2 can include subject matter such as a control device configured for coupling to a fenestration assembly, comprising: a striker assembly including a striker plate configured for coupling to a first fenestration panel; a limiter assembly configured for coupling to a second fenestration panel, the limiter assembly including a rotary element comprising an engagement portion; and wherein the rotary element is rotatable between an engaged position where the engagement portion is positioned to engage the striker plate along a linear axis and a disengaged position in which the engagement portion is misaligned with the striker plate along the linear axis.

Example 3 can include, or can optionally be combined with the subject matter of Example 1 or 2, to optionally include a first track for slidably receiving the first window sash and a second track for slidably receiving the second window sash. The first and second tracks are substantially parallel.

Example 4 can include, or can optionally be combined with the subject matter of Example 3, where the window frame can be oriented such that the first and second tracks are substantially horizontal.

Example 5 can include, or can optionally be combined with the subject matter of Examples 1 or 2, where the striker assembly optionally includes a base plate coupled to the first window sash. The striker plate extends transversely from the base plate.

Example 6 can include, or can optionally be combined with the subject matter of Example 5, where the striker assembly can also include at least one spacer plate positionable between the base plate and the first window sash.

Example 7 can include, or can optionally be combined with the subject matter of Example 1 or 2, where the striker plate optionally includes a stop face angled to engage the engagement portion of the rotary element when the rotary element is rotated into the engaged position to prevent further sliding of the at least one sliding sash.

Example 8 can include, or can optionally be combined with the subject matter of Example 7, where the striker plate also includes an angled face configured to engage the engagement portion of the rotary element to rotate the rotary element into the disengaged position to permit the striker plate to pass by the rotary element allowing further sliding of the at least one sliding sash.

Example 9 can include, or can optionally be combined with the subject matter of Example 1 or 2, where the limiter assembly optionally includes a housing with an internal space; the rotary element positioned therein, the housing including a striker plate opening. The engagement portion of the rotary element extends across the striker plate opening when the rotary element is in the engaged position.

Example 10 can include, or can optionally be combined with the subject matter of Example 9, where the rotary element includes a lever operable to rotate the rotary element between the engaged position and the disengaged position. The housing includes a lever opening, the lever extending from the rotary element through the lever opening.

Example 11 can include, or can optionally be combined with the subject matter of Example 9, where the housing includes a button having a button body and at least one wing, the button movable between a secured position with the button body and wing covering at least a portion of the lever and an exposed position with the button removed from the lever; and a button spring biasing the button toward the secured position.

Example 12 can include, or can optionally be combined with the subject matter of Example 1 or 2, where the rotary element optionally includes a rotary spring that biases the rotary element toward the engaged position. The rotary element can also include a cutout adjacent the engagement portion. Rotating the rotary element into the disengaged position aligns the cutout with the striker plate.

Example 13 can include, or can optionally be combined with the subject matter of Example 1 or 2, where the limiter assembly optionally includes a detent movable between a fixing position with the detent engaged to the rotary element and a release position with the detent disengaged from the rotary element, and a detent spring that biases the detent toward the fixing position.

Example 14 can include, or can optionally be combined with the subject matter of Example 13, where the rotary element includes a cutout adjacent the engagement portion. Rotating the rotary element into the disengaged position aligns the cutout with the striker plate. The cutout receives the detent when the rotary element is in the engaged position and the detent within the cutout retains the rotary element in the engaged position.

Example 15 can include, or can optionally be combined with the subject matter of Example 14, where the striker plate optionally includes a release portion positioned to engage the rotary element when the striker plate passes by the cutout when at least one of the window sashes is slid within the window frame. The engagement of the release portion to the rotary element rotates the rotary element to disengage the detent from the retention notch.

Example 16 can include, or can optionally be combined with the subject matter of Example 14, where the rotary element optionally includes a retention notch, and the detent is received within the retention notch while the rotary element is in the disengaged position, and the detent within the retention notch retains the rotary element in the disengaged position.

Example 17 can include, or can optionally be combined with the subject matter of Example 16, where the second window sash can also comprise a first vertical face and a second vertical face opposite the second vertical face.

Example 18 can include, or can optionally be combined with the subject matter of Example 17, where the limiter assembly is mountable to either the first or second vertical face.

Example 19 can include subject matter such as can include a method for restricting the relative movement of a first window sash and a second window sash in a window frame, comprising: coupling a striker assembly having a striker plate to a first window sash; and coupling a limiter assembly to a second window sash, the limiter assembly including a rotary element having an engagement portion; wherein the rotary element is rotatable to an engaged position where the engagement portion is positioned to engage the striker plate when at least one of the window sashes is slid within the window frame to prevent further movement of the sliding window sash; and wherein the rotary element is rotatable to a disengaged position in which the engagement portion is misaligned with the striker plate allowing the striker plate to pass the engagement portion when at least one of the window sashes is slid within the window frame.

Example 20 can include, or can optionally be combined with the subject matter of Example 19, where the method optionally includes sliding the first window sash to move the striker plate along a linear travel path; interrupting additional sliding of the first window sash by obstructing the striker plate with the engagement portion; rotating the rotary element into an disengaged position with the engagement portion misaligned with the linear travel path of the striker plate; and resuming sliding of the first window sash and moving the striker plate past the engagement portion.

Example 21 can include, or can optionally be combined with the subject matter of Example 19, where the method optionally positioning the striker plate such that the striker plate extends transversely from the first window sash.

Example 22 can include, or can optionally be combined with the subject matter of Example 19, where the method optionally coupling at least one spacer plate between the striker assembly and the first window sash to extend the extension of the striker plate from the first window sash.

Example 23 can include, or can optionally be combined with the subject matter of Example 19, where the method optionally positioning the limiter assembly on the second window sash such that the striker assembly and limiter assembly are aligned along a linear alignment axis parallel to the linear travel path.

Example 24 can include, or can optionally be combined with the subject matter of Example 19, where the rotary element includes a cutout adjacent the engagement portion, and wherein rotating the rotary element into the engaged position aligns the cutout with the linear travel path.

The above detailed description includes references to the accompanying drawings, which form a part of the detailed description. The drawings show, by way of illustration, specific embodiments in which the subject matter can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the subject matter should be determined with reference to the appended claims, along with the full scope of equivalents to which such claims are entitled.

The claimed invention is:

1. A window system, comprising:

a window frame;

a first window sash slidably received within the window frame;

a striker assembly including a striker plate extending transversely from the first window sash, and a release portion;

a second window sash slidably received within the window frame;

a limiter assembly coupled to the second window sash, the limiter assembly including a rotary element comprising an engagement portion with first and second surfaces and a detent biased toward the first and second surfaces;

wherein the rotary element is rotatable to an engaged position, the engagement portion is aligned with the striker plate along a linear axis extending through the striker plate, where the engagement portion is positioned to engage the striker plate when one of at least one of the first and second window sashes is slid within the window frame to prevent further movement of the first and second window sashes, and in the engaged position the detent is engaged with the first surface;

wherein the rotary element is rotatable to a disengaged position in which the engagement portion is misaligned with the linear axis extending through the striker plate, and the detent is engaged with the second surface and holds the rotary element in the disengaged position, allowing the striker plate to pass the engagement portion when one of at least one of the first and second window sashes is slid within the window frame; and wherein with engagement of the release portion against the rotary element, the detent is released from the second surface, and the rotary element is biased and reset from the disengaged position toward the engagement position.

2. The window system of claim 1, wherein the window frame includes:

a first track for slidably receiving the first window sash;

a second track for slidably receiving the second window sash; and wherein the first and second tracks are substantially parallel.

3. The window system of claim 2, wherein the window frame is oriented such that the first and second tracks are substantially horizontal.

4. The window system of claim 1, wherein the striker assembly includes:

a base plate coupled to the first window sash, wherein the striker plate extends transversely from the base plate.

5. The window system of claim 4, wherein the striker assembly includes at least one spacer plate positionable between the base plate and the first window sash.

6. The window system of claim 1, wherein the striker plate includes a stop face oriented to engage the engagement portion of the rotary element in the engaged position to prevent further sliding of the at least one of the first and second window sashes.

7. The window system of claim 6, wherein the release portion of the striker plate includes an angled face configured to engage the engagement portion of the rotary element to rotate the rotary element into the disengaged position to permit the striker plate to pass by the rotary element allowing further sliding of the at least one of the first and second sliding sashes.

8. The window system of claim 1, wherein the limiter assembly includes:

a housing with an internal space, the rotary element positioned therein, the housing including a striker plate opening, and wherein the engagement portion of the rotary element extends across the striker plate opening when the rotary element is in the engaged position.

9. The window system of claim 8, wherein the rotary element includes:

a lever operable to rotate the rotary element between the engaged position and the disengaged position, and wherein the housing includes a lever opening, the lever extending from the rotary element through the lever opening.

10. The window system of claim 9, wherein the housing includes:

a button having a button body and at least one wing, the button movable between a secured position with the button body and the wing positioned to cover at least a portion of the lever and an exposed position with the button removed from the lever.

11. The window system of claim 1, wherein the rotary element includes:

a rotary spring that biases the rotary element toward the engaged position.

12. The window system of claim 1, wherein the rotary element includes a cutout adjacent the engagement portion, and wherein rotating the rotary element into the disengaged position aligns the cutout with the striker plate.

13. The window system of claim 1, wherein the limiter assembly includes a detent spring that biases the detent toward the first and second surfaces.

14. The window system of claim 13, wherein the second surface includes a retention notch adjacent the engagement portion, and rotating the rotary element into the disengaged position aligns a cutout of the rotary element with the striker plate, and the retention notch receives the detent when the rotary element is in the disengaged position and the detent within the retention notch retains the rotary element in the disengaged position.

15. The window system of claim 14, wherein the release portion is positioned to engage the rotary element when the striker plate passes by the cutout when at least one of the first and second window sashes is slid within the window frame, wherein the engagement of the rotary element by the release portion rotates the rotary element to disengage the detent from the retention notch.

16. The window system of claim 1, wherein the second window sash comprises a first vertical face and a second vertical face opposite the first vertical face.

17. The window system of claim 16, wherein the limiter assembly is mountable to the first vertical face.

18. The window system of claim 16, wherein the limiter assembly is mountable to the second vertical face.

19. A control device configured for selectively limiting movement of at least one fenestration panel, comprising:

a striker assembly including a striker plate configured for coupling to a first fenestration panel and a release portion;

a limiter assembly configured for coupling to a second fenestration panel, the limiter assembly including a rotary element having an engagement portion with first and second surfaces and a detent biased toward the first and second surfaces;

wherein the rotary element is rotatable between an engaged position and a disengaged position:

in the engaged position, the engagement portion of the rotary element is aligned with the striker plate along a linear axis extending through the striker plate, and the detent is engaged with the first surface, and in the disengaged position, the engagement portion of the rotary element is positioned out of alignment with the linear axis extending through the striker plate, and the detent is engaged with the second surface and holds the rotary element in the disengaged position, wherein at least one of the first fenestration panel and the second fenestration panel are slidable parallel to the linear axis; and wherein with engagement of the release portion against the rotary element, the detent is released from the second surface, and the rotary element is biased and reset from the disengaged position toward the engaged position.

20. The control device of claim 19, wherein the striker assembly includes:

a base plate configured for coupling to the first fenestration panel, and wherein the striker plate extends transversely from the base plate.

21. The control device of claim 20, wherein the striker assembly includes at least one spacer plate affixable to the base plate opposite the striker plate.

22. The control device of claim 19, wherein the striker plate includes a stop face oriented to engage the engagement portion of the rotary element in the engaged position.

23. The control device of claim 22, wherein the striker plate includes an angled face configured to engage the engagement portion of the rotary element and rotate the rotary element to the disengaged position.

24. The control device of claim 19, wherein the limiter assembly includes:

a housing with an internal space, the rotary element positioned therein, the housing including a striker plate opening, and wherein the engagement portion of the rotary element extends across the striker plate opening when the rotary element is in the engaged position.

25. The control device of claim 24, wherein the rotary element includes:

a lever operable to rotate the rotary element between the engaged position and the disengaged position, and wherein the housing includes a lever opening, and the lever extends from the rotary element through the lever opening.

26. The control device of claim 25 comprising a button having a button body and at least one wing, the button movable between a secured position with the button body and the at least one wing covers at least a portion of the lever and an exposed position with the button remote from the lever, and the lever is exposed.

27. The control device of claim 19, wherein the rotary element includes a rotary spring that biases the rotary element toward the engaged position.

28. The control device of claim 19, wherein the rotary element includes a cutout adjacent the engagement portion, and wherein rotating the rotary element into the disengaged position aligns the cutout with the striker plate along the linear axis.

29. The control device of claim 19, wherein the detent is movable between a fixing position with the detent engaged to the rotary element and a release position with the detent disengaged from the rotary element, and a detent spring biases the detent toward the fixing position.

30. The control device of claim 29, wherein the first surface of the rotary element includes a cutout adjacent the engagement portion, and the second surface of the rotary element includes a retention notch;

wherein rotating the rotary element into the disengaged position aligns the cutout with the striker plate, and wherein the retention notch receives the detent when the rotary element is in the disengaged position and the detent within the retention notch retains the rotary element in the disengaged position.

31. The control device of claim 30, wherein the release portion is configured to engage the rotary element when the striker plate passes by the cutout when at least one of the fenestration panel is slid within a fenestration frame, wherein the engagement of the rotary element by the release portion rotates the rotary element to disengage the detent from the retention notch.

32. The control device of claim 19, wherein each fenestration panel comprises a first vertical face and a second vertical face opposite the first vertical face.

33. The control device of claim 32, wherein the limiter assembly is mountable to the first vertical face.

34. The control device of claim 33, wherein the limiter assembly is mountable to the first vertical face.

35. The control device of claim 19, wherein the detent is released and the rotary element is reset from the disengaged position to the engaged position with engagement of the release portion against the engagement portion of the rotary element.

36. The control device of claim 19, wherein the first surface includes a cutout of the rotary element.

37. The control device of claim 36, wherein the striker plate is configured to pass through the cutout in the disengaged position.

38. The control device of claim 19, wherein the second surface includes a notch of the rotary element.

39. A control device configured for selectively limiting movement of at least one fenestration panel, comprising:

a striker assembly including a striker plate configured for coupling to a first fenestration panel;

a limiter assembly configured for coupling to a second fenestration panel, the limiter assembly including a rotary element comprising an engagement portion and a cutout, wherein the limiter assembly includes a retention portion configured to hold the rotary element in a disengaged position;

wherein the striker assembly includes a release portion, and the rotary element is configured to disengage the retention portion from the rotary element with engagement of the release portion against the rotary element; and wherein the rotary element is rotatable between an engaged position and the disengaged position:

in the engaged position, the engagement portion of the rotary element is aligned with the striker plate along a linear axis extending through the striker plate, and in the disengaged position, the engagement portion of the rotary element is out of alignment with the linear axis extending through the striker plate and the cutout is aligned with the striker plate, and the striker plate is slidable through the rotary element at the cutout with movement of either of the first or second fenestration panels.

40. The control device of claim 39, wherein the retention portion includes a detent biased toward the rotary element.

41. The control device of claim 39, wherein the rotary element is biased toward the engaged position from the disengaged position with disengagement of the retention portion.

* * * * *